United States Patent [19]

Andreason et al.

[11] Patent Number: 4,660,575

[45] Date of Patent: Apr. 28, 1987

[54] CIGARETTE EXTINGUISHER

[76] Inventors: Chris N. Andreason, 5398 South 1410 East, Salt Lake City, Utah 84117; Michael C. Bingham, 1617 E. 9400 So., Sandy, Utah 84092

[21] Appl. No.: 712,428

[22] Filed: Mar. 18, 1985

[51] Int. Cl.[4] ..... A24F 13/18; A24F 13/16

[52] U.S. Cl. ..... 131/256; 131/175; 131/237

[58] Field of Search ..... 131/256, 235.1, 237, 131/125

[56] References Cited

U.S. PATENT DOCUMENTS

| | | | |
|---|---|---|---|
| 1,490,939 | 4/1924 | Rogers | 131/256 |
| 2,002,494 | 5/1935 | Eisenberg | 131/256 |
| 2,113,745 | 4/1938 | Pyatt | 131/235.1 |
| 2,335,674 | 11/1943 | Horlick | 131/256 |
| 2,715,961 | 8/1955 | Field | 131/256 |
| 3,234,951 | 2/1966 | Schilling | 131/235.1 |

FOREIGN PATENT DOCUMENTS

| | | | |
|---|---|---|---|
| 212485 | 11/1940 | Switzerland | 131/256 |

*Primary Examiner*—Vincent Millin
*Assistant Examiner*—H. Macey
*Attorney, Agent, or Firm*—Marcus G. Theodore

[57] ABSTRACT

This invention is a cigarette extinguisher which can readily be inserted into a conventional pack of cigarettes or the pocket of a user. It comprises a hollow cylinder with open ends, sized to store therein a lighted cigarette. A removable end cap covers one end to removably seal the same. A slidable keeper is mounted proximate the open end to releasably hold via a friction fit a cigarette inserted therein.

7 Claims, 2 Drawing Figures

CIGARETTE EXTINGUISHER

BACKGROUND OF THE INVENTION

1. Field: This invention relates to cigarette extinguishers and snuffers, and more particularly to a portable readily storable cigarette extinguisher.

2. State of the Art: Various cigarette extinguishers and snuffers are known. E. G. Johnson, U.S. Pat. No. 2,120,027 describes a cigarette extinguisher with a plurality of flanges at the bottom of a hollow cylinder to receive and hold the lighted end of a cigarette. The device is portable, but does not extend to cover and provide protection to the unlit portion of the cigarette. The unlighted cigarette segment thus can be bent or damaged. M. Horlick, U.S. Pat. No. 2,335,674 discloses a two piece cigarette conserver. A cigarette is placed in the one end of the barrel piece and a cap piece is then placed thereon to cover the unlit end. This two piece construction is subject to the same loss problems as a fountain pen, i.e. a user loses either the top or bottom; thereby affecting the operability of the invention. H. Stackowiak, U.S. Pat. No. 2,246,642 discloses another two piece cigarette extinguisher which is subject to the same problems as Horlick. L. Mertzel, U.S. Pat. No. 2,536,302 is another two piece cigarette extinguisher and retrieving device. Mertzel has an elaborate internal structure which is difficult to manufacture, and is subject to the same loss problems as Horlick and Stachowiak. J. J. Dorrance, U.S. Pat. No. 3,173,641 discloses a combination ash tray and snuffer. Essentially, Dorrance is a short closed end tube in which the lighted end of a cigarette is placed. A base positions the tube to receive the cigarette such that the cigarette is held in the snuffer by gravity. The contents of the ash tray and snuffer are readily lost in the event that the device is tipped or dropped upside down. W. R. Field, U.S. Pat. No. 2,715,961 discloses a three piece safety extinguisher with two compartments. The first compartment extinguishes smoking material. The second compartment extinguishes matches. The three pieces can be lost and are not sized to fit within a conventional package of cigarettes.

Thus, there remains a need for a portable one piece extinguisher sized of sufficient dimensions to accomodate and temporarily store cigars, cigarettes and cylindrical smoking materials and at the same time fit within a conventional pack or box.

SUMMARY OF THE INVENTION

Applicant's invention is a one piece light weight portable extinguisher which can readily be inserted into a conventional pack of cigarettes or the pocket of the user. The extinguisher comprises a hollow cylinder with an open first end and a closed second end. The length of the cylinder is sized to store within it a cigarette or cigar, or similar cylindrically rolled smoking material hereinafter referred to as a cigarette. The first end of the cylinder is sized such that its cross section is sealed by the unlit end of an inserted cigarette. When sealed, the first end prevents ashes from escaping from the cylinder when the cylinder is inverted. The closed second end collects gases from the lighted end of the cigarette, building up within the cylinder a nonburning gaseous atmosphere which rapidly extinguishes cigarettes. This prevents burnt tar build-up, causing bitterness when the cigarette is re-lit.

Within the cylinder is an internal longitudinal groove proximate the first end. Preferably, this groove is cylindrical in shape. A keeper is slideably mounted within the groove. The keeper has a cylindrical bore sized smaller than the diameter of the cigarette to form a friction fit with an inserted cigarette. When engaged by an inserted cigarette, the keeper slides toward the second end of the cylinder, carrying the inserted cigarette. When the cylinder is inverted or shaken, the keeper carrying the cigarette moves toward the first end of the cylinder to extend the cigarette beyond the first end a predetermined distance so that the cigarette may be retrieved from the extinguisher. The keeper may be structured as an expandable split ring to accomodate various circumference sizes of cigarettes, or it may include finger like flexible projections constricting the keeper bore to hold an inserted cigarettte until removed by the user. The fingers of the keeper must be structured not to damage the cigarette when it is withdrawn.

In one preferred embodiment, the second end of the cylinder is also open and includes a removable cap to cover the second end. When the second end is capped, the cylinder acts as an extinguisher to put out the cigarette as well as collect ashes dropped from the lighted cigarette. Thus the extinguisher can be used as a portable ash tray as well. Periodically, the cap may be removed and the ashes emptied.

A clip attached to the exterior of the cylinder is usually included to attach the extinguisher to a pack of cigarettes or the pocket of a user. The extinguisher may then be readily carried.

The length of the cylinder is preferably sized to accomodate the full length of an unlit cigarette. However, the cylinder should be of a length not to exceed the dimensions of a conventional pack or boxes of cigarettes when carried. In this manner, after one or two cigarettes have been used out of the pack, the extinguisher itself may be stored within the box or pack for storage. The pack of cigarettes may so be structured to include a storage compartment to store an extinguisher, or may have an extinguisher built into the package.

The exterior of the cylinder is generally colored and patterned to suit the preference of the user. Preferably light weight materials such as heat resistant plastics and nylons are used to construct the cylinder. These materials should have some insulating properties to prevent the transfer of heat onto the user.

The extinguisher can be constructed of inexpensive disposable materials so that they may be handed out in smoker sections, used, and then discarded. Other more permanent extinguishers can be constructed of metallic and enameled materials. These more permanent extinguishers are colored and patterned in a wide number of varieties to suit the preference of a user. They are maintained by a dry brushing of the cylinder to clean and correct any sticking of the keeper. An occasional wet cleaning may be accomplished by removing the end cap, applying a mild cleanser or pipe sweetener to the inside and brushing from both ends.

For those regularly using the extinguisher, smoking consumption is dramatically reduced without the loss of sufficient nicotine to satisfy the physical needs of most people. Not only does this save money, but the health hazards from smoke exposure are reduced. For many who have gradually reduced smoking, it is much easier to quit entirely.

The extinguisher collects burnt gas to extinguish rapidly the flame of the cigarette without creating charred or burnt tars. The device thus functions similarly as other snuffers without the complex casing structures and the problems associated with multipart devices. The extinguisher enables the user to take one or two draws on the cigarette and then save the remainder. As the inserted lighted cigarette rapidly extinguishes and self seals the cylinder opening, secondary smoke from the burning cigarette is not transmitted into the room environs. The extinguisher thus minimizes not only the cigarette intake required to satisfy the user, but also minimizes secondary smoke entering the room. Applicant's invention thus provides a device which minimizes smoke exposure to non-smokers in restricted areas such as airlines, trains, and other smoking compartments not effectively separated by barriers. Applicant's invention provides a distinct improvement over the art references, and a cleaner way of putting out a cigarette.

ILLUSTRATED EMBODIMENTS

Figure 1:
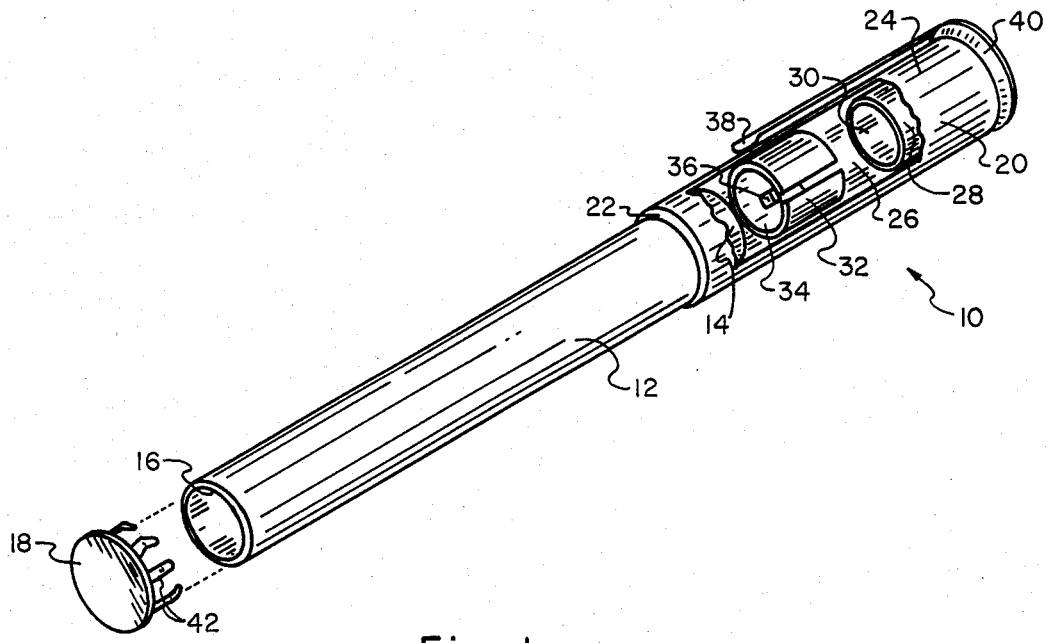
FIG. 1 is a perspective view of one embodiment of the invention.

FIG. 1 is a perspective view of one embodiment of applicant's invention 10. The invention 10 comprises a hollow cylinder 12 with open ends 14, 16. A removable cap 18 covers end 16 to seal the end and collect smoke fumes from a lit cigarette. The smoke build up and oxygen loss within the cylinder 12 usually extinguishes the cigarette in approximately five seconds or less. A second hollow cylinder 20 with open ends 22, 24 slides over and is sealed to the cylinder 12 proximate end 14 forming a cylindrical chamber 26. An end piece 28 with a cylindrical bore 30 is inserted within the end 24 of the second hollow cylinder 20 to cap the cylindrical chamber 26. Mounted within the cylindrical groove 26 is a keeper 32 with a cylindrical bore 34 sized to accomodate the circumferential cross section of an inserted cigarette. The keeper 32 has a friction bump 36 which forms a friction fit with the inserted cigarette. A clip 38 attached to the exterior of the end piece 28 proximate end 40 is used to attach the invention 10 to a pack of cigarettes or the pocket of a user.

A plurality of flanges 42 secures the cap 18 within the open end 16, although other conventional capping systems may be used.

Figure 2:
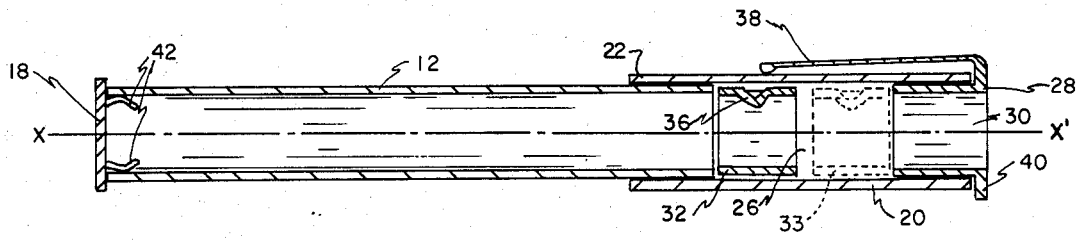
FIG. 2 is a cross-sectional view of the embodiment shown in FIG. 1.

FIG. 2 is a cross-sectional view of the invention 10 showing the cylinderical internal chamber 26 in which the keeper 32 is mounted. The cross-sectional diameter of the end piece 28 bore 30 is sized to form a seal with the unlit end of an inserted cigarette to prevent ashes from falling out the open end 40.

The keeper 32 slides forward and backward within the groove 26. Shown in the phantom lines is the keeper 32 in its most extended positon 33 within the cylindrical chamber 26 proximate the end piece 28. As it slides, the keeper 32 carries the cigarette and prevents it from accidentally falling out. To remove the cigarette, the extinguisher 10 is shaken or tipped causing the keeper 32 to move toward the open end 40. As the keeper 32 moves, it carries and extends the unlit end of the cigarette from the open end 40 sufficiently to be grasped by a user.

The invention 10 is used by an individual lighting a cigarette. After a couple of puffs on the cigarette, the lighted end of the cigarette is inserted first into the open end 40 of the invention 10. The cigarette is then inserted until the unlit end of the cigarette is flush with the open end 40. Gases from the burning cigarette build up within the cylinder 12 and extinguish the cigarette. The invention 10 is then stored in a pack of cigarettes or the pocket of a user until the cigarette is to be retrieved.

To retrieve the cigarette, the user tips or shakes the invention 10 until the keeper 32 carries and extends the unlit end of the cigarette beyond the open end 40 of the invention 10 approximately one-half inch. The user then grasps and removes the cigarette for re-lighting.

The exterior of the extinguisher cylinder is colored and patterned to suit the preference of a user. It is preferably constructed of a light weight, heat resistent, insulated material.

Although the invention has referred to the specific embodiments, it is not intended to restrict the scope of the appended claims. The claims themselves recite those features deemed essential to the invention.

I claim:

1. An extinguisher for extinguishing cigarettes, cigars, and other cylindrical smoking materials comprising:

a hollow cylinder with an open first end and a closed second end of sufficient length to store therein a cigarette, the open first end sized to be sealed by the unlit end of an inserted cigarette to prevent ashes from escaping, and having an internal cylindrical chamber defined by the interior of the cylinder wall proximate the first end; and a cylindrical keeper having two opposed open ends, said keeper having means to removably hold a cigarette and being longitudinally slideably mounted within the cylindrical chamber in the extinguisher, said keeper having a longitudinal cylindrical bore extending between said two opposed open ends and being suffiently sized to accommodate the cross-sectional diameter of the inserted cigarette, and means extending radially into the bore opening to partially restrict said opening to form a friction hold on an inserted cigarette; said cylinder further comprising means for limiting the longitudinal movement of said keeper so as to retain said keeper entirely within said hollow cylinder cylindrical chamber, said limiting means further defining the longitudinal boundaries of said cylindrical chamber; said keeper in one mode capable of sliding within the groove to hold and carry an inserted cigarette toward the second end of the cylinder for storage; and in another mode capable of sliding back toward the first end of the cylinder to carry and extend the unlighted ends of the cigarette beyond the first end sufficiently so that the cigarette may be retrieved by a user.

2. An extinguisher according to claim 1, wherein the closed end comprises a removable cap attached to the second end to seal the second end when capped.

3. An extinguisher according to claim 1, including a clip attached to the exterior of the cylinder to removably attach the cylinder to a pack of cigarettes or support selected by the user.

4. An extinguisher according to claim 1, wherein the cylinder is of a length sized to fit within a pack of conventional cigarettes.

5. An extinguisher according to claim 1, wherein the cylinder is constructed of a light weight, heat resistant insulated material.

6. An extinguisher according to claim 1, wherein the restriction and friction forming means comprises a friction bump projecting radially into the cylindrical bore to removably hold an inserted cigarette.

7. An extinguisher according to claim 1, wherein the keeper is structured as an expandable split ring to removably hold various sized circumference cigarettes inserted into the extinguisher.

* * * * *